US005421259A

United States Patent [19]

Shiba et al.

[11] Patent Number: 5,421,259

[45] Date of Patent: Jun. 6, 1995

[54] GUIDE ROLLER FOR PRINTING PRESS

[75] Inventors: Noriyuki Shiba, Tokyo; Noritake Harada, Kanagawa; Daisuke Nakamura, Kanagawa, all of Japan

[73] Assignee: Kabushiki Kaisha Tokyo Kikai Seisakusho, Japan

[21] Appl. No.: 116,957

[22] Filed: Sep. 7, 1993

Related U.S. Application Data

[63] Continuation-in-part of Ser. No. 16,572, Feb. 11, 1993, abandoned.

[30] Foreign Application Priority Data

Sep. 24, 1992 [JP] Japan ..... 4-277741

[51] Int. Cl.[6] ..... B41F 1/44

[52] U.S. Cl. ..... 101/232; 101/216; 492/28; 492/38; 492/39; 492/43; 220/190; 220/193

[58] Field of Search ..... 101/216, 425, 232; 492/28, 38, 39, 43, 44; 226/190, 193

[56] References Cited

U.S. PATENT DOCUMENTS

| | | | |
|---|---|---|---|
| 1,576,726 | 3/1926 | Davis | 492/39 |
| 2,404,159 | 7/1946 | Barber | 492/38 |
| 3,718,959 | 3/1973 | Sailas | 492/38 |
| 4,192,050 | 3/1980 | Appenzeller | 492/44 |
| 4,462,456 | 7/1984 | Kameyama | 492/26 |
| 4,717,938 | 1/1988 | Tanjo | 492/38 |
| 4,833,987 | 5/1989 | Hardin | 101/348 |
| 5,193,459 | 3/1993 | Barbour | 101/269 |

*Primary Examiner*—Edgar S. Burr
*Assistant Examiner*—John S. Hilten
*Attorney, Agent, or Firm*—Ronald P. Kananen

[57] ABSTRACT

A guide roller for a printing press is designed to prevent foreign matters, such as ink or so forth from adhering on the peripheral surface thereof and to sweep up the peripheral surface by a traveling web. The guide roller comprises a roller body having a peripheral surface to contact with a traveling web. The roller body incorporates a first peripheral surface for converting the traveling speed of the web into a first rotational speed and a second peripheral surface having a different geometry to the first peripheral surface for converting the traveling speed of the web into a second rotational speed, the second peripheral surface being cooperative with the first peripheral surface for interacting the second rotational speed with the first rotational speed for determining a rotational speed of the guide roller so that the peripheral speed of the guide roller is differentiated from the traveling speed of the web.

24 Claims, 5 Drawing Sheets

GUIDE ROLLER FOR PRINTING PRESS

CROSS REFERENCE TO THE RELATED APPLICATION

The present application is a Continuation-in-Part application of U.S. patent application Ser. No. 08/016,572, filed on Feb. 11, 1993, now abandoned.

BACKGROUND OF THE INVENTION

1. Field of the Invention

The present invention relates to a guide roller for handling traveling printed sheet, such as paper web, in a guide roller device of a rotary press, for example.

2. Description of the Related Art

Guide rollers in a guide roller device for a rotary printing press, for example, are arranged for guiding web traveling from a paper web supply section to a folding section through a printing section to desired orientations. Due to friction, the guide rollers are rotated at a peripheral substantially equal speed to the traveling speed of the traveling web.

Accordingly, foreign matters, such as ink and so forth may be transferred on the peripheral surface of the guide roller to contact with the web printed at the printing section. Such foreign matters adhering on the peripheral surface of the guide roller may cause scumming or tinting of the subsequently fed web to degrade printing quality. Furthermore, the foreign matters on the peripheral surface of the guide roller have to be removed by manual operation of personnel or by a special device during an interval of printing or after completion of printing.

As an approach for such drawback, the commonly assigned Japanese Unexamined Patent Publication 1-209139 proposes an improved guide roller device. The disclosed guide roller device includes two or more guide rollers. At least one of the guide rollers are associated through a torque transmission mechanism so as to rotate at a peripheral speed different from that of other guide rollers. The association of at least one of the guide rollers to others is so established as to rotate all of the guide rollers while establishing a balance of torque due to frictional forces acting between the outer peripheries of all guide rollers and the web for preventing the foreign matters, such as inks and so forth, from adhering by scrubbing of the web on the peripheral surface of the guide roller by providing slight difference of the peripheral speed of the guide roller and the traveling speed of the web. In addition, the disclosed guide roller device permits automatic sweeping of the guide roller.

The above-mentioned conventional device employs the frictional force between the web and the peripheral surface of the guide roller as driving force for rotation of guide roller, and adjusts the peripheral speed of the guide roller to be slightly different from the traveling speed of the web in self-adjusting manner within an allowable tension range of the web. This enables to scrub the web on the peripheral surface of the guide roller without causing unnecessary tension load on the web.

However, the above-mentioned conventional device requires the torque transmission mechanism for maintaining association of a plurality of guide rollers to make the construction complicated. In addition, associated works, such as maintenance and so forth is increased thereby increasing the cost.

On the other hand, the peripheral speeds of a plurality of guide rollers which are associated by the torque transmission mechanism associates and drives all guide rollers in the condition where torque by the frictional force acting between the peripheral surface of the associated guide rollers and the web is balanced. Accordingly, when the frictional force between one of the associated guide rollers and the traveling web is excessively larger than those of other guide rollers, such one of the guide rollers may rotate substantially irrespective of the rotation of other rollers so that the peripheral speed thereof and the traveling speed of the web becomes substantially equal to each other. Then, with to the peripheral surface of such guide roller, scrubbing effect by the traveling web is hardly expected.

On the other hand, in a large scale rotary press, such as a newspaper press, a feeding path of the medium from the feeding section to the folding section is substantially long. A plurality of guide rollers are arranged along the feeding path. The moment of inertia of rotation of these guide rollers is accumulated so that a substantially large inertia force is applied to the medium to cause various problems.

As a solution for this, Japanese Examined Patent Publication (Kokoku) No. 3-12541, Japanese Examined Utility Model Publication No. 3-6612, Japanese Unexamined Patent Publication (Kokai)No. 63-92564, Japanese Unexamined Patent Publication No. 3-286847 and Japanese Unexamined Patent Publication No. 4-89755 propose light weight rollers, which employ a fiber reinforced plastic cylinder as a primary material with fitting on the peripheral surface thereof a metal cylinder or a metal plating or the combination thereof, in order to reduce the moment of inertia.

Since the light weight roller is provided high rigidity and low moment of inertia, it may eliminate the drawback which otherwise encountered upon starting up and stopping. Also, for small moment of inertia, a tension to be applied to the medium becomes small to reduce contacting force between the medium and the light weight roller. This reduces adhering of the foreign matter. However, the latter problem, i.e. scumming or tinting of the peripheral surface of the guide roller, cannot be completely eliminated to require removal of the foreign matter with interrupting printing or after completion of printing.

Furthermore, the fiber reinforced plastic cylinder is formed by lamination of reinforcement fiber and the plastic, it has relatively low circularity and straightness. Therefore, the light weight roller employing such cylinder as the primary material tends to have relatively low rotating balance. Therefore, there is a need for the light weight roller to easily adjust the balance.

SUMMARY OF THE INVENTION

In view of the drawbacks set forth above, it is an object of the present invention to provide a guide roller which is simple and less expensive and can assure differentiation of the peripheral speed of a guide roller from a traveling speed of a web.

Another object of the present invention is to provide a lightweight roller which can be provided inexpensively and without causing increasing of associated works, such as maintenance.

A further object of the invention is to provide a lightweight roller which can avoid adhering or accumulation of the foreign matter on the peripheral surface thereof.

A still further object of the invention is to provide a lightweight roller which can be easily adjusted to a rotational balance.

In order to accomplish the above-mentioned object, a guide roller according to the present invention is provided a unique configuration to geometrically convert the traveling speed of a web into mutually different peripheral speeds at different positions on the roller. The different peripheral speeds at different positions may interact to each other to determine the rotational speed of the guide roller so as to differentiate the peripheral speed of the roller from the traveling speed of the web.

According to one aspect of the invention, a guide roller for a printing press comprises:

a roller body having a peripheral surface to contact with a traveling web;

first means incorporated in the roller body for converting the traveling speed of the web into a first rotational speed;

second means incorporated in the roller body and having a different geometry to the first means for converting the traveling speed of the web into a second rotational speed, the second means cooperative with the first means for interacting the second rotational speed with the first rotational speed for determining a rotational speed of the guide roller so that the peripheral speed of the guide roller is differentiated from the traveling speed of the web.

In the preferred construction, the first and second means comprises portions of the guide roller respectively forming parts of the outer peripheries at mutually different first and second diameters. In this case, an area ratio of a peripheral surface of the first and second diameters may be selected so as to permit simultaneous contact of the first and second means to the traveling web. Preferably, the area ratio of a peripheral surface of the first and second diameters is selected within a range of 1:3 to 3:1. In the alternative, the ratio of the first and second diameters is selected so that the diameter of the first means may be 95% to 99.5% of that of the second means.

The second means may comprise at least one ridge extending substantially circumferentially about the roller and having an outer peripheral surface offset radially outward from an outer peripheral surface of the first means. If desired, the ridge may extend in a substantially spiral fashion over a length of the roller.

According to another aspect of the invention, a guide roller for a printing press for guiding a traveling web at a position downstream of a printing section, comprises:

a roller body having a peripheral surface to contact with the traveling web;

a first roller component having a first peripheral surface located at a first diametric position, the first peripheral surface contacting with the traveling web; and a second roller component having a second peripheral surface located at a second diametric position which is different from the first diametric position, the second peripheral surface contacting with the traveling web simultaneously with the first peripheral surface.

In this case, the guide roller may comprise a plurality of the first roller components and a plurality of the second roller components arranged alternatingly and integrated to each other for rotation together. The first and second roller components may be arranged in alternating fashion.

According to a further aspect of the invention, a light weight guide roller for a printing press comprising:

a roller body having a cylindrical core made of a plastic based composite material and a peripheral surface to contact with a traveling web;

first means incorporated in the roller body for converting the traveling speed of the web into a first rotational speed;

second means incorporated in the roller and having a different geometry to the first means for converting the traveling speed of the web into a second rotational speed, the second means cooperative with the first means for interacting the second rotational speed with the first rotational speed for determining a rotational speed of the guide roller so that the peripheral speed of the guide roller is differentiated from the traveling speed of the web.

In this case, the cylindrical core of the roller body may carry a metallic surface member attached on the peripheral surface thereof. The first means may have a first geometric configuration adapted for converting the traveling speed of the web into the first rotational speed and the second means has a second geometric configuration adapted for converting the traveling speed of the web into the second rotational speed, the first and second rotational speeds being interacting to each other for determining the rotational speed of the roller body as a composite speed. The metallic surface member may define the first and second geometric configurations of the peripheral surface of the roller body.

In the preferred construction, the guide roller may further comprise end members secured on both axial ends of the cylindrical core, which end members supports the roller body in rotatable fashion. The end members may be fixedly secured on both axial ends of the cylindrical body and has means for establishing a rotational balance of the roller body. The end members may preferably be formed into an annular ring shaped configuration to be fitted on the inner periphery of the cylindrical core, and the means for establishing the rotational balance of the roller body comprises at least one of void formed in the end member and weight attached on the end member.

According to a still further aspect of the invention, a guide roller for a printing press for guiding a traveling web at a position downstream of a printing section, comprises:

a roller body having a cylindrical core made of a plastic based composite material, a metal layer fitted on the peripheral surface of the cylindrical core and a metallic surface coating layer formed on the peripheral surface of the metallic layer;

a first roller component defined by the metallic layer of the roller body and having a first peripheral surface located at a first diametric position, the first peripheral surface contacting with the traveling web; and a second roller component defined by the metallic layer and having a second peripheral surface located at a second diametric position which is different from the first diametric position, the second peripheral surface contacting with the traveling web simultaneously with the first peripheral surface.

Preferably, the cylindrical core is made of a fiber reinforced plastic, the metal layer is formed of a metal sleeve fitted on the peripheral surface of the cylindrical core and having alternatively arranged a first portion defining the first peripheral surface and a second portion defining the second peripheral surface.

In the preferred construction, the first peripheral surface and the second peripheral surface are arranged in an area ratio of 1:10 to 10:1. Also, the first peripheral surface has a circle in cross section having a diameter approximately 95% or more but less than 100% of a diameter of a circle defined by the second peripheral surface in cross section.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

Figure 1:
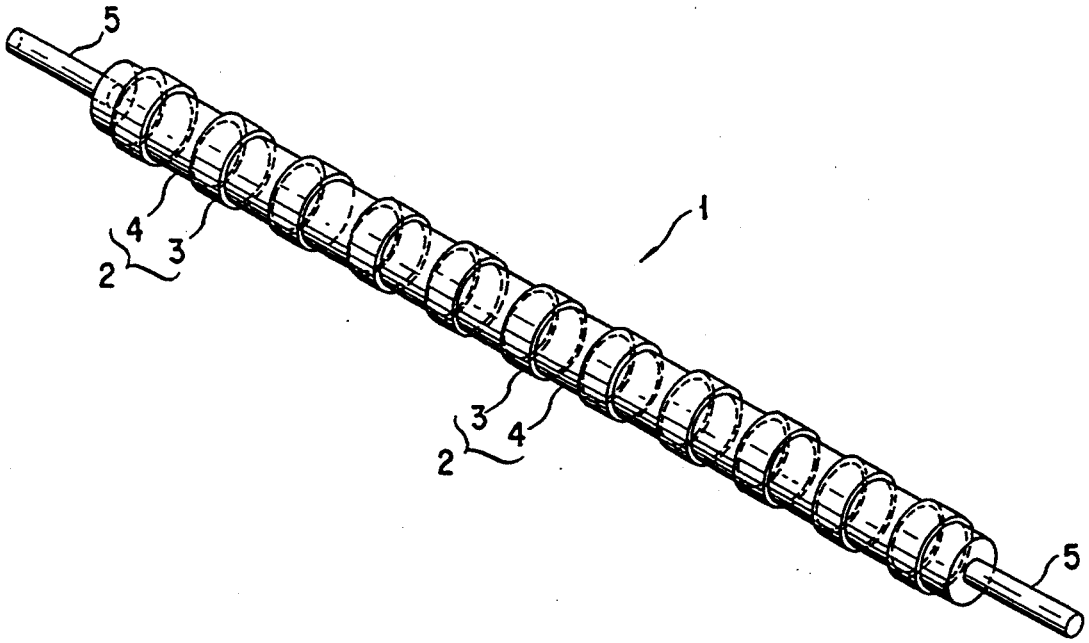
FIG. 1 is a fragmentary perspective view of the preferred embodiment of a guide roller assembly according to the present invention.
Figure 2:
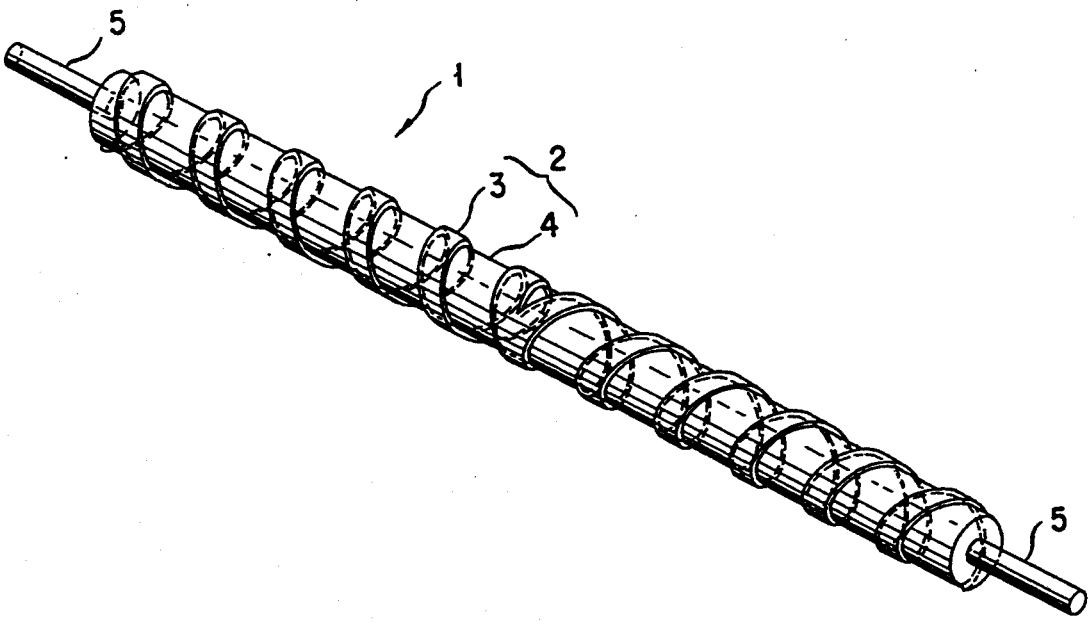
FIG. 2 is a fragmentary perspective view of another embodiment of a guide roller according to the invention.
Figure 3:
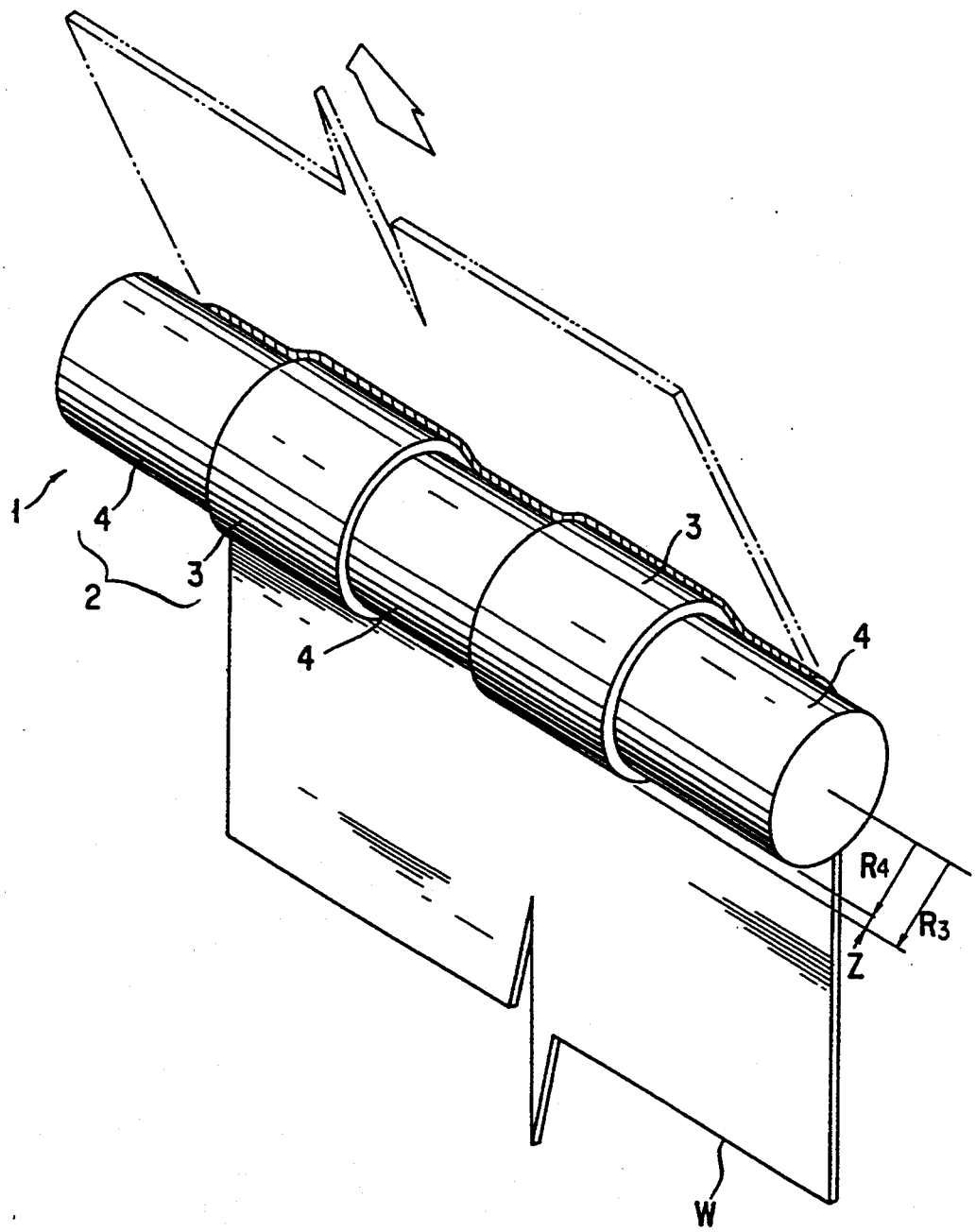
FIG. 3 is a partially sectioned perspective view showing the condition where a guide roller of FIGS. 1 or 2 is contacting with a web.

The present invention will be discussed in terms of preferred embodiments of FIGS. 1 to 3, in which FIGS. 1 and 2 show fragmentary perspective views of guide rollers, and FIG. 3 shows a partially sectioned perspective view showing a condition where the guide roller is contacting with a web.

In the drawings, the reference numeral 1 denotes a guide roller. The guide roller 1 has a peripheral surface 2 which is constituted of alternately arranged larger diameter peripheral portions 3 and smaller diameter peripheral portions 4. The guide roller 1 may be mounted on a roller shaft 5 for rotation thereabout so that a roller body having alternately arranged larger and smaller diameter peripheral portions contacting with a web W may rotate about the roller shaft 5 in response to traveling of the web W. In the alternative, the guide roller 1 may be fixed to the roller shaft 5 which is rotatable, so that the guide roller body can be rotated together with the shaft 5 in response to traveling of the web W.

In case of the guide roller 1 of FIG. 1, the closed loops of the larger diameter peripheral portions 3 and the smaller diameter peripheral portions 4 are axially arranged in the alternating fashion to form the peripheral surface 2 of the guide roller 1. On the other hand, in case of the roller 1 of FIG. 2, spiral form larger diameter peripheral portion 3 and smaller diameter peripheral portion 4 are arranged in alternating fashion to form the peripheral surface 2 of the guide roller 1.

In either case of the guide roller 1, as shown in FIG. 3, the radius $R_3$ of the larger diameter peripheral portion 3 and the radius $R_4$ of the smaller diameter peripheral portion 4 are selected so that a difference Z of the radii permits simultaneous contact of the web W onto both of the larger diameter peripheral portions 3 and the smaller diameter peripheral portions 4 and may subsequently cause slip between the web W and the peripheral surface 2 of the guide roller 1. Therefore, the radii of the larger diameter peripheral portions 3 and the smaller diameter peripheral portions 4 are determined with taking various factors, such as the stiffness of the web and so forth, into account. For instance, the radius $R_4$ of the smaller diameter peripheral portion 4 can be selected to be 95% to 99.5% of the radius $R_3$ of the larger diameter peripheral portion 3.

On the other hand, the area ratio of a peripheral of the area of the larger diameter peripheral portions 3 and the smaller diameter peripheral portions 4 is determined appropriately in consideration of a balance between a contact area between the larger diameter peripheral portions 3 and the web W and a contact area between the smaller diameter peripheral portions 4 and the web W so that slip can be caused between the peripheral surface 2 of the guide roller 1 and the web W. For instance, the area ratio of the area of the larger diameter peripheral portions 3 versus the area of the smaller diameter peripheral portions 4 can be 1:3 to 3:1.

Next, discussion will be given for guiding of the web W by means of the guide roller 1 constructed as set forth above.

By guiding the traveling web W by the peripheral surface 2 of the guide roller 1, the guide roller 1 is rotated according to travel of the web W by a frictional force between the peripheral surface 2 thereof and the web W contacting thereonto.

Here, the peripheral surface Z of the guide roller 1 is constituted by the larger diameter peripheral portions and the smaller diameter peripheral portions 4 as set forth above. The web W travels at a speed V with simultaneously contacting with the larger diameter peripheral portions 3 and the smaller diameter peripheral portions 4. Accordingly, the larger diameter peripheral portions 3 are driven to rotate at an angular velocity of $V/R_3$, and while the smaller diameter peripheral portions 4 are driven to rotate at an angular velocity of $V/R_4$.

However, since the larger diameter peripheral portions 3 and the smaller diameter peripheral portions 4 of the guide rollers 1 are formed integrally, it does not permit to rotate the larger diameter peripheral portions 3 and the smaller diameter peripheral portions 4 to rotate at mutually different angular velocities. Therefore, the guide roller 1 rotates at an angular velocity $\omega$ which is established by mutually affecting the angular velocity $V/R_3$ of the larger diameter peripheral portions 3 and the angular velocity $V/R_4$ of the smaller diameter peripheral portions 4. As a result, between the peripheral surface 2 of the guide roller 1 and the web W, namely, between the larger diameter peripheral portions 3 and the web W and between the smaller diameter peripheral portions 4 and the web, slip is caused so that the peripheral surface 2 of the guide roller 1 is scrubbed by the web W.

The angular velocity $\omega$ of the guide roller 1 is determined by balancing the frictional force induced by the slip between the larger diameter peripheral portions 3 and the web W and the frictional force induced by the slip between the smaller diameter peripheral portions 4 and the web W and can be expressed by:

$$(V/R_3)<\omega<(V/R_4)$$

Accordingly, the peripheral surface 2 of the guide roller 1 is certainly scrubbed by the web W which travels while keeping contact. This prevents the foreign matters, such, as inks and so forth, from adhering on the peripheral surface 2 and enables automatic sweeping thereof.

As set forth above, according to the present invention, the peripheral surface 2 of the guide roller 1 can be scrubbed by the traveling web W by certainly inducting difference of the peripheral speed to the traveling speed of the web. Therefore, the foreign matter, such as ink or so forth, may not adhere on the peripheral surface of the guide roller. Furthermore, by slip caused between the peripheral surface of the guide roller and the web, the peripheral surface can be automatically swept by the traveling web. Accordingly, the sweeping and cleaning operation with interrupting printing operation or after printing becomes unnecessary to contribute for saving energy and labor.

In addition, the present invention can be implemented simply by replacing the conventional guide roller with the proposed guide roller. Furthermore, the cost for the guide roller can be held relatively inexpensive. Therefore, the guide roller according to the present invention may contribute for improvement of the existing printing press for reduction of running cost and/or maintenance cost.

Figure 4:
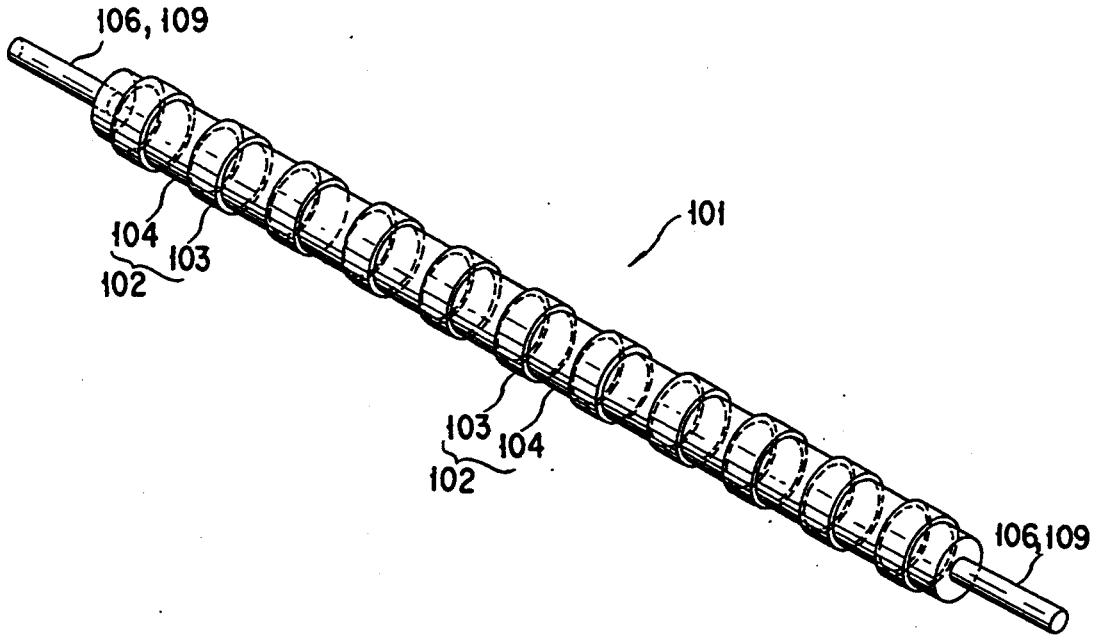
FIG. 4 is a perspective view of another embodiment of a guide roller according to the present invention.
Figure 5:
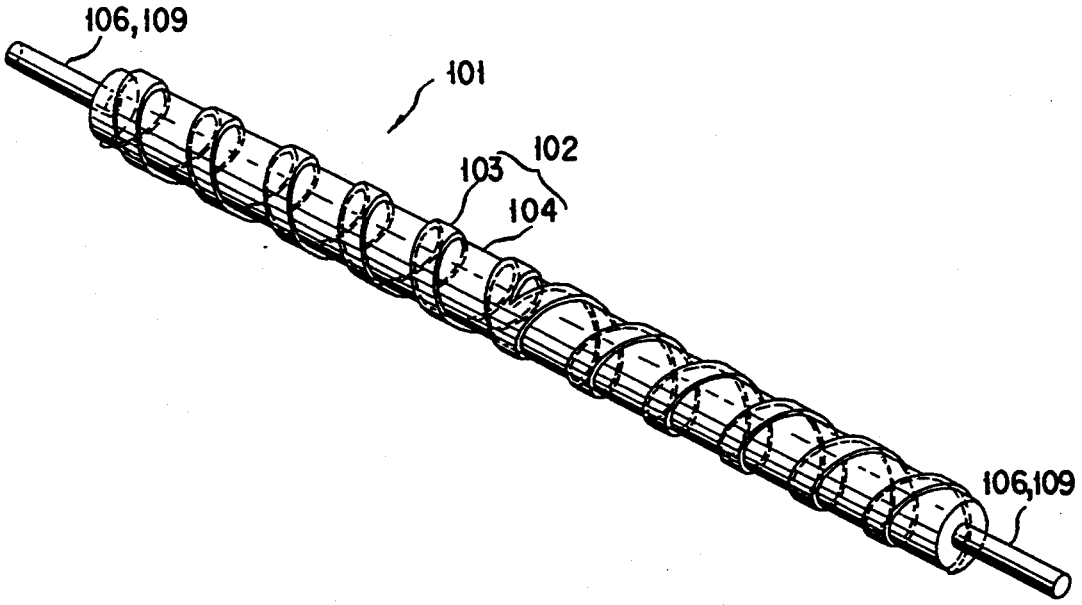
FIG. 5 is a perspective view of further embodiment of a guide roller according to the present invention.

Referring FIGS. 4 to 8 another embodiment of a guide roller is generally represented by the reference numeral 101. The guide roller 101 has a peripheral surface 102, in which larger diameter peripheral portions 103 and smaller diameter peripheral portions 104 are arranged alternately. The guide roller 101 has a cylindrical core 105 made of a composite material, i.e. a fiber reinforced plastic formed by laminating fiber layer or layers and plastic layer or layers, or by impregnating molten plastic in a fiber based prepreg. Any suitable fiber, such as carbon fiber, may be used as the reinforcement. The peripheral surface of the cylindrical core 105 of the composite material is covered with a metal sleeve 110 made of copper, aluminum or so forth for preventing the reinforcement fiber from causing fuzzing and for forming a base for plating set out later. On the peripheral surface of the metal sleeve 110, the larger diameter peripheral portions 103 and the smaller diameter peripheral portions 104 are formed in alternating fashion, as shown in FIGS. 4 and 5. For hardening and smoothing the peripheral surface, the surface of the metal sleeve 110 is coated by hard chrome plating 111.

Figure 6:
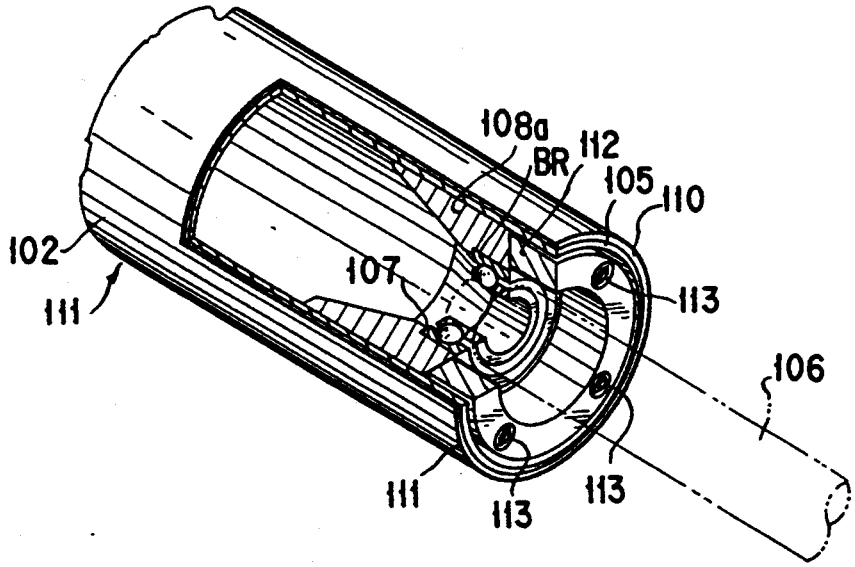
FIG. 6 is a partially sectioned perspective view of one embodiment of one end of the guide roller of FIG. 4 or 5, which illustrates the peripheral surface in uniform diameter for simplification.
Figure 7:
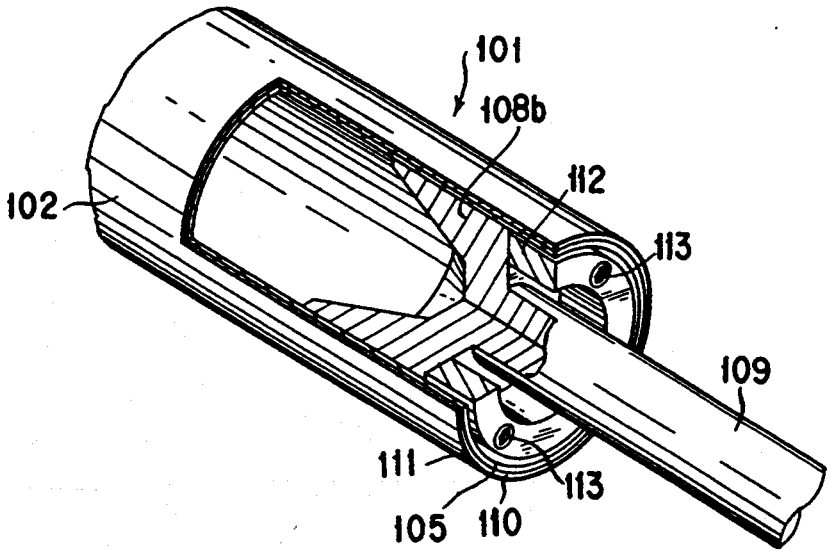
FIG. 7 is a partially sectioned perspective view of another embodiment of one end of the guide roller of FIG. 4 or 5, which illustrates the peripheral surface in uniform diameter for simplification.

End members **108*a* or 108*b* respectively shown in FIGS. 6 and 7 are fitted on the inner periphery of the cylindrical core 105 at both axial ends of the guide roller 101 of either forms illustrated in FIGS. 4 and 5. The end member 108*a* has a bearing housing 107 for receiving therein a bearing BR for rotatably accommodating a stationary shaft 106 stationarily extended from a stationary component of the rotary press. With this construction, the guide roller 101 rotates about the stationary shaft 106. Alternatively, the end member 108*b* has a shaft 109 extending therefrom so that it may be rotatably received on a bearing mounted on a constructional component of the rotary press. In this case, the guide roller 101 rotates with the shaft 109** about the bearing (not shown).

As can be seen, the guide roller 101 illustrated in FIG. 7 has the larger diameter peripheral portions 103 in respectively independent closed loop forms. Alternatively, the guide roller 101 illustrated in FIG. 8 has a series of larger diameter peripheral portions 103 extending in spiral fashion.

Figure 8:
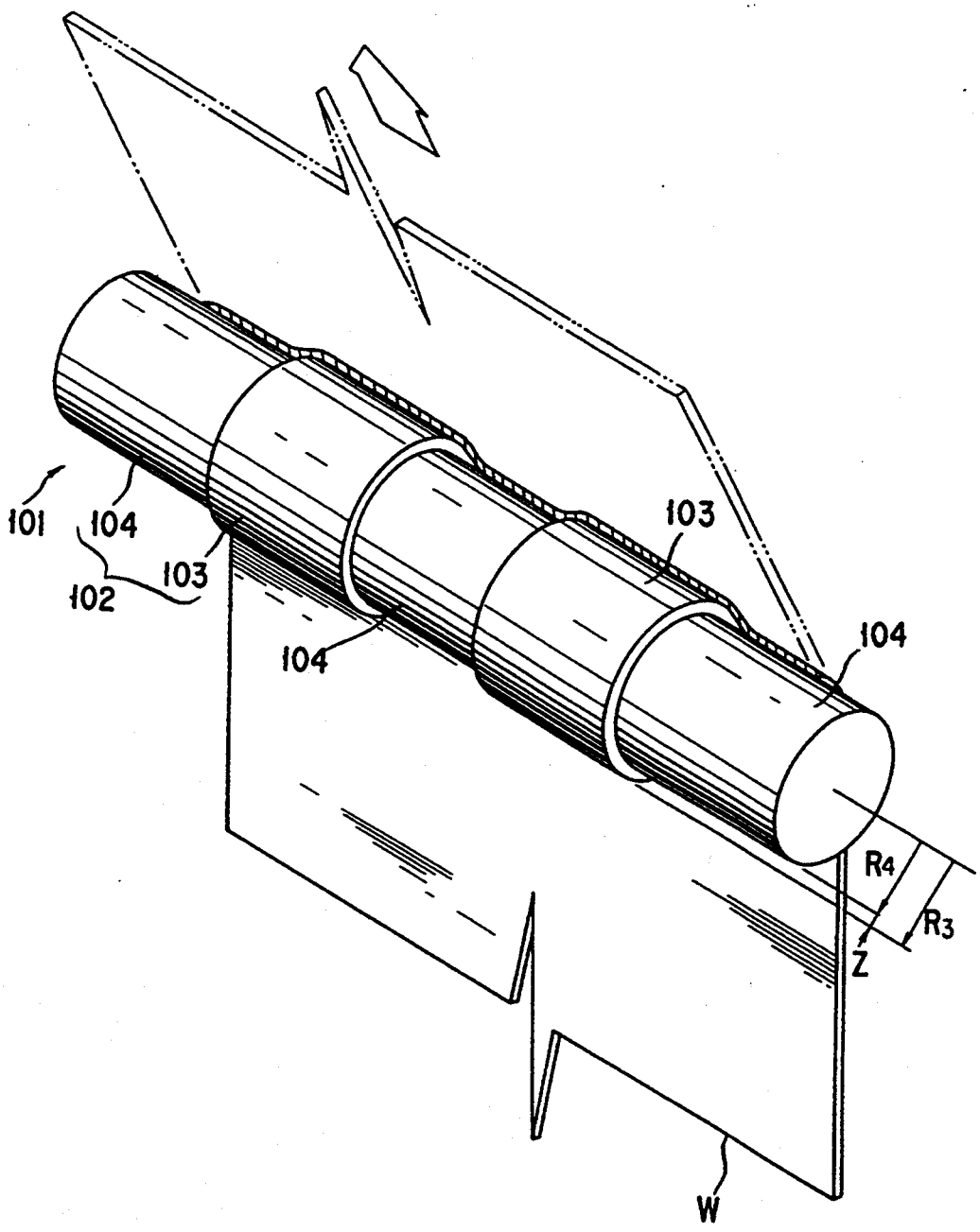
FIG. 8 is a partially sectioned perspective view illustrating a contacting condition between the guide roller of FIG. 4 or 5 and the medium to be printed.

In either case, as shown in FIG. 8, the larger diameter peripheral portions 103 have radius $R_3$ greater than the radius $R_4$ of the smaller diameter peripheral portions 104. The difference Z between the radius $R_3$ of the lager diameter peripheral portions 103 and the radius $R_4$ of the smaller diameter peripheral portions 104 is selected so that both of the larger diameter peripheral portions 103 and the smaller diameter peripheral portions 104 may contact simultaneously with a web W to be printed and may cause a slip on the larger diameter peripheral portions 103 as discussed later. Therefore, the difference Z may be variable depending upon the properties of the web, such as stiffness or so forth. For example, the radius $R_4$ of the smaller diameter peripheral portion 104 may be 95% of the radius $R_3$ of the larger diameter peripheral portion 103.

On the other hand, the area ratio between the larger diameter peripheral portions 103 and the smaller diameter peripheral portions 104 is also selected to permit slip on the larger diameter peripheral portions 103. In consideration of a balance of the contact area between the larger diameter peripheral portions 103 and the web W versus the contact area between the smaller diameter peripheral portions 104 and the web W, the area ratio may be selected in a range of 1:10~10:1.

In addition, on the outer end surface of the end members **108*a* and 108*b*, one or more balance adjusting members 112 may be detachably fitted by means of bolts 113, for example, as shown in FIGS. 6 and 7**.

The function of the guide roller 101 as set forth above in guiding the web W will be discussed hereinafter. set forth above, the guide roller 101 guides the web W to be printed while contacting the peripheral surface 102 thereof on the surface of the web W. Since the guide roller 101 is light in weight and thus has a small moment of inertia, the web W may travel with a small tension. The guide roller 101 is driven to rotate according to traveling of the web W by transmission of the force from the web W due to frictional force between the peripheral surface 102 and the web W contacting thereto.

Here, as set forth, the peripheral surface 102 of the guide roller 101 is constituted of larger diameter peripheral portions 103 and the smaller diameter peripheral portions 404. The web W travels while maintaining simultaneous contact with the larger diameter peripheral portions 103 and the smaller diameter peripheral portions 104 at a traveling speed V. Then, the larger diameter peripheral portions 103 receive the force for rotation at an angular velocity of $V/R_3$ whereas the smaller diameter peripheral portions 104 receive the force for rotation at an angular velocity of $V/R_4$. Due to mutual influences of the angular velocities $V/R_3$ and $V/R_4$, the guide roller 101 rotates at an angular velocity $\omega$. As a result, slip is caused between the outer peripheries of the larger diameter peripheral portions 403 and the web W, and between the outer peripheries of the smaller diameter peripheral portions 104 and the web W. Therefore, the peripheral surface 102 of the guide roller 101 can be scratched by the traveling web.

The angular velocity $\omega$ in rotation of the guide roller 101 is determined depending upon a balance between the frictional force with a slip between the outer peripheries of the larger diameter peripheral portions 103 and the web W, and the frictional force with a slip between the outer peripheries of the smaller diameter peripheral portions 104 and the web W, and thus can be expressed by:

$$(V/R_3)<\omega<(V/R_4)$$

Accordingly, the peripheral surface 102 of the guide roller 101 can be certainly scratched by the traveling web W and thus the foreign matter, such as ink and so forth can be swept out automatically.

On the other hand, as pointed out above, the cylindrical core made of the fiber reinforced plastic is unstable in circularity and straightness to cause necessity of adjustment of the rotational balance for the guide roller 101 employing such cylindrical core as the primary material. The shown embodiment of the guide roller facilitates adjustment of the rotational balance by means of the annular balance adjusting member 112. For establishing desired level of rotational balance, the annular balance adjusting member 112 may be processed, e.g. through machining, drilling or so forth, or in the alternative by fitting metal weight within the machined recesses or drilled holes. As can be appreciated, the annular balance adjusting members 112 are fitted at both ends of the guide roller 101. The annular balance adjusting members 112 may be fitted at one end of the guide roller 101.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

For instance, although specific constructions of the embodiments of the guide roller according to the present invention have been described, the larger diameter peripheral portions and the smaller diameter peripheral portions can be arbitrarily determined depending upon application. Furthermore, it is not necessary to have the uniform characteristics over the entire surface of the peripheral surface of the guide roller. Therefore, it is possible to locally provide different characteristics of the peripheral surface of the guide roller. Furthermore, the guide roller according to the present invention can be constructed with various processes. For instance, the guide roller with the larger diameter peripheral portions and the smaller diameter peripheral portions can be formed by carving the smaller diameter peripheral portions from the uniform diameter roller. In the alternative, the larger diameter peripheral portions may be formed by attaching a strip form member onto the uniform diameter roller. Also, it may be possible to form the larger diameter peripheral portions and the smaller diameter peripheral portions through a single process.

What is claimed is:

1. A guide roller for a printing press comprising:

a roller body having an outer peripheral surface for contact with a traveling web;

first means incorporated in said outer peripheral surface of said roller body and being kept in contact with the traveling web for converting a traveling speed of the web into a first peripheral speed;

second means incorporated in said outer peripheral surface of said roller body, and having a different geometry than said first means and being kept in contact with and traveling web for converting the traveling speed of the web into a second peripheral speed different from said first peripheral speed, said second means cooperating with said first means for interacting said second peripheral speed with said first peripheral speed so that the first and second peripheral speeds of said guide roller are different from the traveling speed of the web.

2. A guide roller as set forth in claim 1, wherein said first and second means comprises portions of said guide roller respectively forming parts of said peripheral surfaces at mutually different first and second diameters.

3. A guide roller as set forth in claim 2, wherein an area ratio of a peripheral surface of said first and second diameters is selected so as to permit simultaneous contact of said first and second means to said traveling web.

4. A guide roller as set forth in claim 3, wherein said area ratio of a peripheral surface of said first and second diameters is selected within a range of 1:3 to 3:1.

5. A guide roller as set forth in claim 3, wherein the ratio of said first and second diameters is selected so that the diameter of said first means is 95% to 99.5% of that of said second means.

6. A guide roller as set forth in claim 1, wherein said second means comprises at least one ridge extending substantially circumferentially about said roller, said at least one ridge having an outer peripheral surface offset radially outward from an outer peripheral surface of said first means.

7. A guide roller as set forth in claim 6, wherein said at least one ridge extends in a substantially spiral fashion over a length of the roller.

8. A guide roller for a printing press for guiding a traveling web at a position downstream of a printing section, comprising:

a roller body having a peripheral surface to contact with the traveling web;

a first roller component having a first peripheral surface located at a first diametric position, said first peripheral surface contacting with the traveling web;

a second roller component having a second peripheral surface located at a second diametric position which is different from said first diametric position, said second peripheral surface contacting with the traveling web simultaneously with said first peripheral surface; and said roller body being rotated by the traveling web, said first and second peripheral surfaces having first and second peripheral speeds, said first and second peripheral speeds being different from a speed of the traveling web.

9. A guide roller as set forth in claim 8, wherein said guide roller comprises a plurality of said first roller components and a plurality of said second roller components arranged alternatingly and integrated to each other for rotation together.

10. A guide roller as set forth in claim 8, wherein said first and second roller components are arranged in alternating fashion.

11. A light weight guide roller for a printing press comprising:

a roller body having a cylindrical core made of a plastic based composite material and an outer peripheral surface to contact with a traveling web;

first means incorporated in said outer peripheral surface of said roller body and being kept in contact with the traveling web for converting a traveling speed of the web into a first peripheral speed;

second means incorporated in said outer peripheral surface of said roller body, having a different geometry to said first means and being kept in contact with the traveling web for converting the traveling speed of the web into a second peripheral speed, said second means cooperative with said first means for interacting said second peripheral speed with said first peripheral speed so that the first and second peripheral speeds of said guide roller are different from the traveling speed of the web.

12. A guide roller as set forth in claim 11, wherein said cylindrical core of said roller body carries a metallic surface member attached on the peripheral surface thereof.

13. A guide roller as set forth in claim 11, wherein said first means has a first geometric configuration adapted for converting the traveling speed of said web into said first rotational speed and said second means has a second geometric configuration adapted for converting the traveling speed of said web into said second rotational speed, said first and second rotational speeds being interacting to each other for determining the rotational speed of said roller body as a composite speed.

14. A guide roller as set forth in claim 13, wherein said cylindrical core of said roller body carries a metallic surface member attached on the peripheral surface thereof, said metallic surface member defining said first and second geometric configurations of said peripheral surface of said roller body.

15. A guide roller as set forth in claim 11, which further comprises end members secured on both axial ends of said cylindrical core, which end members supports said roller body in rotatable fashion.

16. A guide roller as set forth in claim 15, wherein said end members are fixedly secured on both axial ends of said cylindrical body and has means for establishing a rotational balance of said roller body.

17. A guide roller as set forth in claim 16, wherein said end members are formed into an annular ring-shaped configuration to be fitted on the inner periphery of said cylindrical core, and said means for establishing the rotational balance of said roller body comprises a void formed in said end member.

18. A guide roller for a printing press for guiding a traveling web at a position downstream of a printing section, comprising:

a roller body having a cylindrical core made of a plastic based composite material, a metallic layer fitted on the peripheral surface of said cylindrical core and a metallic surface coating layer formed on the peripheral surface of said metallic layer;

a first roller component defined by said metallic layer of said roller body and having a first peripheral surface located at a first diametric position, said first peripheral surface contacting with the traveling web;

a second roller component defined by said metallic layer and having a second peripheral surface located at a second diametric position which is different from said first diametric position, said second peripheral surface contacting with the traveling web simultaneously with said first peripheral surface; and said roller body being rotated by the traveling web, said first and second peripheral surfaces having first and second peripheral speeds, said first and second peripheral speed being different from a speed of the traveling web.

19. A guide roller as set forth in claim 18, wherein said cylindrical core is made of a fiber reinforced plastic, said metal layer is formed of a metal sleeve fitted on the peripheral surface of said cylindrical core and having alternatively arranged a first portion defining said first peripheral surface and a second portion defining said second peripheral surface.

20. A guide roller as set forth in claim 19, wherein said first peripheral surface and said second peripheral surface are arranged in an area ratio of 1:10 to 10:1.

21. A guide roller as set forth in claim 19, wherein said first peripheral surface has a circle in cross section having a diameter approximately 95% or more but less than 100% of a diameter of a circle defined by said second peripheral surface in cross section.

22. A guide roller for a printing press for guiding a traveling web at a position downstream of a printing station, comprising:

a roller body having an outer periphery to contact with the traveling web;

a first roller component having a first peripheral surface located at a first diametric position, said first peripheral surface contacting with the traveling web to be driven by the traveling web at a first peripheral speed determined by a traveling speed of the web and a first diameter at said first peripheral surface; and a second roller component integrated with said first roller component, having a second peripheral surface located at a second diametric position which is different from said first diametric position, said second peripheral surface contacting with the traveling web simultaneously with said first peripheral surface to be driven by the traveling web at a second peripheral speed determined by a traveling speed of the web and a second diameter at said second peripheral surface and interacting with said first peripheral speed of said first roller component for rotating the said first and second peripheral surfaces at said first and second peripheral speeds, said first and second speeds being different than the speed of the traveling web.

23. A guide roller for a printing press for guiding a traveling web at a position downstream of a printing station, comprising:

a roller body having a cylindrical core made of a plastic based composite material, a metallic layer fitted on the outer periphery of said cylindrical core and a metallic surface coating layer formed on the outer periphery of said metallic layer;

a first roller component defined by said metallic layer of said roller body and having a first peripheral surface located at a first diametric position, said first peripheral surface contacting with the traveling web to be driven by the traveling web at a first peripheral speed determined by a traveling speed of the web and a first diameter at said first peripheral surface; and a second roller component defined by said metallic layer and having a second peripheral surface located at a second diametric position which is different from said first diametric position, said second peripheral surface contacting with the traveling web simultaneously with said first peripheral surface to be driven by the traveling web at a second peripheral speed determined by a traveling speed of the web and a second diameter at said second peripheral surface and interacting with said first peripheral speed of said first roller component for rotating the said first and second peripheral surfaces at said first and second peripheral speeds, said first and second speeds being different than the speed of the traveling web.

24. A guide roller as set forth in claim 16, wherein said end members are formed into an annular ring-shaped configuration to be fitted on the inner periphery of said cylindrical core, and said means for establishing the rotational balance of said roller body comprises a weight attached on said end member.

* * * * *